US008201599B2

(12) United States Patent
Kokko

(10) Patent No.: US 8,201,599 B2
(45) Date of Patent: Jun. 19, 2012

(54) DEBARKING MECHANISM AND METHOD

(75) Inventor: Pekka Kokko, Hollola (FI)

(73) Assignee: Andritz Oy, Helsinki (FI)

( * ) Notice: Subject to any disclaimer, the term of this patent is extended or adjusted under 35 U.S.C. 154(b) by 0 days.

(21) Appl. No.: 13/235,734

(22) Filed: Sep. 19, 2011

(65) Prior Publication Data

US 2012/0024426 A1 Feb. 2, 2012

Related U.S. Application Data

(62) Division of application No. 11/568,129, filed as application No. PCT/FI2005/050126 on Apr. 19, 2005, now Pat. No. 8,020,594.

(30) Foreign Application Priority Data

Apr. 20, 2004 (FI) ..... 20045140

(51) Int. Cl.
*B27L 1/00* (2006.01)
*B27L 1/04* (2006.01)

(52) U.S. Cl. ..... 144/340; 144/208.9

(58) Field of Classification Search .... 144/208.1–208.9, 144/340, 341
See application file for complete search history.

(56) References Cited

U.S. PATENT DOCUMENTS

| | | | | |
|---|---|---|---|---|
| 5,394,912 | A | 3/1995 | Hume | |
| 5,699,843 | A | 12/1997 | Gagne | |
| 6,588,467 | B2 | 7/2003 | Havumaki et al. | |
| 6,619,345 | B2 | 9/2003 | Havumaki et al. | |
| 6,619,346 | B2 | 9/2003 | Havumaki et al. | |
| 8,020,594 | B2 * | 9/2011 | Kokko | 144/208.1 |
| 2003/0159760 | A1 | 8/2003 | Peetso et al. | |

FOREIGN PATENT DOCUMENTS

| | | |
|---|---|---|
| FI | 28777 | 4/1957 |
| FI | 112181 | 11/2003 |
| SE | 8007901 | 5/1982 |

OTHER PUBLICATIONS

International Search Report mailed Aug. 29, 2005.
Written Opinion mailed Aug. 29, 2005.

* cited by examiner

*Primary Examiner* — Shelley Self
(74) *Attorney, Agent, or Firm* — Nixon & Vanderhye P.C.

(57) ABSTRACT

A debarking mechanism including of rotatable debarking shafts extending parallel to an advancing direction (A) of the logs to be fed therethrough, which are provided with teeth extending beyond the circumferential surface of the shaft. At least the uppermost debarking shaft is moved sideways towards the inner part of the debarking mechanism in such a way that each debarking shaft directs an impact effect on logs colliding with it and moved by the debarking shafts located in a lower position. The circumferential speed of the debarking shaft is selected to be the greater the higher the debarking shaft is positioned. A free passage is arranged for the bark passing over the debarking shaft.

15 Claims, 5 Drawing Sheets

DEBARKING MECHANISM AND METHOD

RELATED APPLICATION

This application is a divisional of U.S. application Ser. No. 11/568,129 filed on Oct. 20, 2006 which is a US national phase of international application PCT/FI2005/050126 filed 19 Apr. 2005 which designated the U.S. and claims benefit of FI 20045140 filed 20 Apr. 2004, the entire contents of which are hereby incorporated by reference.

BACKGROUND OF INVENTION

The invention relates to a debarking mechanism for the decortication or pretreatment of logs for separately performed final debarking and for the discharge of at least some of the bark removed from a log stream passing through the debarking mechanism, the debarking mechanism comprising a number of rotatable debarking shafts extending parallel to the advancing direction of the logs to be fed therethrough, which are provided with a number of teeth extending beyond the circumferential surface of the shaft and arranged to strip bark off the logs being processed, transversely to the longitudinal direction of the logs, and at the same time to convey the logs transversely relative to the said shafts, the said shafts, together with the teeth thereof, being arranged to form at least a part of a support surface, on which the logs being processed travel through the debarking mechanism, and the said debarking shafts being arranged relative to each other in such a way that the logs being processed perform a rotary motion in the debarking mechanism, in which motion the logs on the support surface formed by the debarking shafts, are forced, in their turn, by the effect of the rotary motion of the debarking shafts, into the upper position, from which they roll down into the lower position on top of the other logs in the debarking mechanism.

This type of prior known debarking mechanisms are provided with fingerplates between the uppermost debarking shaft and the side wall of the debarking mechanism—in some mechanisms also between the debarking shafts—to prevent logs from being wedged between the debarking shaft and the side wall of the debarking mechanism or between two debarking shafts, and thus to prevent the wedged log from being broken.

The bark can usually be discharged from between the debarking shaft and the fingerplate or between two debarking shafts. Bark detached from the logs in long strips causes problems by clogging the gaps between the uppermost debarking shaft and the related fingerplates, thus causing the bark to collect into big clots at these uppermost fingerplates.

SUMMARY OF INVENTION

In order to eliminate these disadvantages, the debarking mechanism of the invention has been arranged in such a way that of the debarking shafts forming the said part of the support surface for the logs, at least the uppermost debarking shaft has been moved sideways towards the inner part of the debarking mechanism in such a way that the said debarking shaft directs an impact effect on logs colliding with it and moved by the debarking shafts located in a lower position, due to the effect of which the direction of movement of the logs having collided with the said debarking shaft will change in such a way that, when dividing the movement into a horizontal and a vertical component, the horizontal component of movement will point towards the inner part of the debarking mechanism, that the circumferential speed of the debarking shaft is selected to be the greater the higher the debarking shaft is positioned, and that a free passage has been arranged for the bark passing over the uppermost debarking shaft, along which the bark is discharged from the debarking mechanism.

The new position of the uppermost debarking shaft has the effect that, at best, the logs cannot rise above this uppermost debarking shaft at all. The arrangement here is that a free passage is arranged for the bark passing over the uppermost debarking shaft, along which the bark is discharged from the debarking mechanism. This may be realized, for example, by arranging an opening in the side wall of the debarking mechanism at the uppermost debarking shaft, in such a way that the bark conveyed by the uppermost debarking shaft are removed from the debarking mechanism through the said opening.

It is further arranged that the higher the position of the debarking shaft, the greater the selected circumferential speed of the debarking shaft. On the one hand, this arrangement prevents the logs from being wedged between the debarking shafts and, on the other hand, facilitates the discharge of the bark from debarking mechanism.

After the said uppermost debarking shaft may of course also be arranged further debarking shafts or similar means, for example, for the further conveyance of the bark. What is essential, however, is that any such additional shafts are no longer comprised in the above-mentioned support surface formed by the debarking shafts, on which surface the logs being processed travel through the debarking mechanism. The purpose of the said uppermost debarking shaft is precisely to prevent the logs from entering the area above the said support surface.

Normally, however, provisions must be made for the logs at least occasionally rising above the uppermost debarking shaft. For such a case, the arrangement is preferably such that a guiding surface is fitted in conjunction with the uppermost debarking shaft, the said guiding surface forming, together with the uppermost debarking shaft, a slot converging in the direction of rotation of the debarking shaft. On the one hand, a guiding surface of this type facilitates the entry of the bark into the said slot and, on the other hand, prevents the logs from entering into the slot between the guiding surface and the uppermost debarking shaft.

The guiding surface is preferably provided with grooves for interlocking the said guiding surface and the teeth of the uppermost debarking shaft.

A freely rotating roller or a roller rotated by a suitable actuator has proven to be the most efficient embodiment of the guiding surface.

SUMMARY OF THE DRAWINGS

The invention will be described in greater detail in the following, with reference to the accompanying drawings, in which.

DETAILED DESCRIPTION OF THE INVENTION

Figure 2:
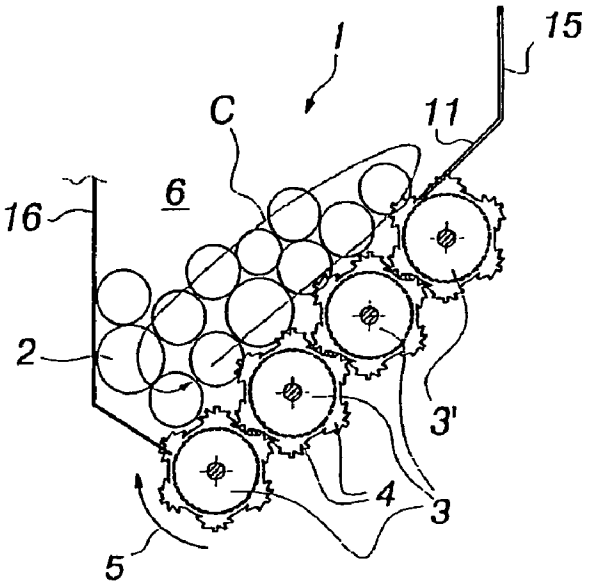
Prior art Fig. 2
FIG. 2 shows a section along line II-II in FIG. 1.

The debarking mechanism 1 shown in the drawings is intended for the decortication or pretreatment of logs 2 for separately performed final debarking and for the discharge of at least some of the bark removed from the wood stream passing through the debarking mechanism.

The debarking mechanism 1 comprises a number of rotatable debarking shafts 3, 3' extending parallel to the advancing direction A (FIG. 1) of the logs 2 to be fed therethrough, the ends of the debarking shafts being pivoted on the end plates 13 (FIG. 1) at the ends of the debarking mechanism 1.

To rotate the shafts 3, 3', one or both of their ends is provided with, for example, a sprocket 14. The shafts 3, 3' are rotated in the direction of the arrow 5 (FIG. 2).

The debarking shafts 3, 3' are provided with a number of teeth 4 extending beyond the circumferential surface of the debarking shaft and arranged to strip bark off the logs 2 being processed transversely to the longitudinal direction of the logs and at the same time to convey the logs transversely relative to the said debarking shafts.

Figure 1:
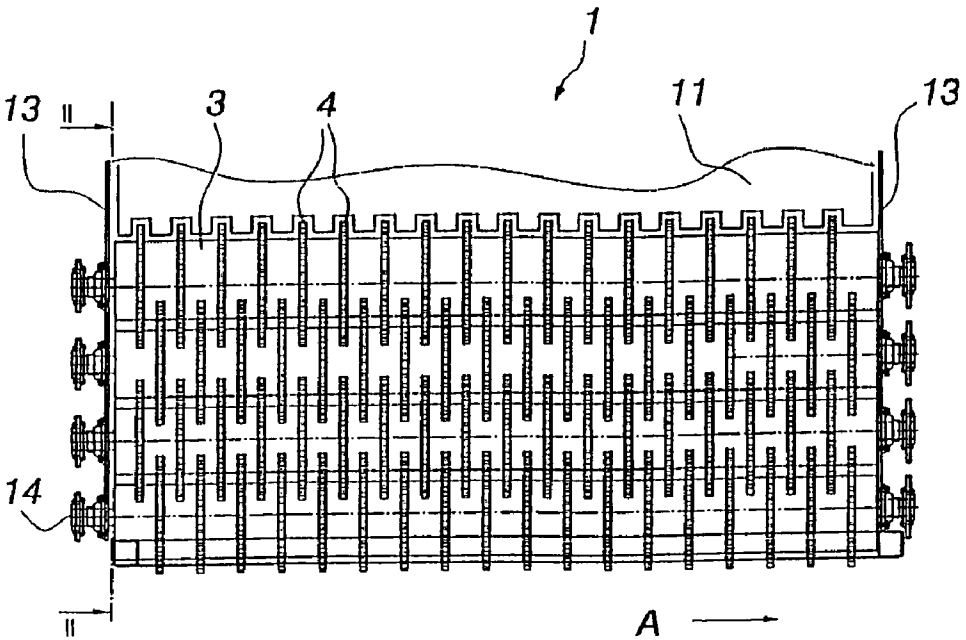
Prior art Fig. 1
FIG. 1 shows the debarking shafts of a prior art debarking mechanism as a schematic side view.

The debarking shafts 3, 3', together with the teeth 4 thereof, form a part of the support surface carrying the logs 2 through the debarking mechanism 1. FIGS. 1 and 2 show an example of a prior art mechanism comprising four debarking shafts 3, 3', the said shafts being arranged relative to each other so as to form an inclined plane, as can be best seen in FIG. 2. The debarking shafts 3, 3' form a sloping plane also in the advancing direction A of the logs. Other than that, the support surfaces are solid surfaces 15, 16 designed so as to provide, together with the support surface formed by the debarking shafts, an open-ended chute extending from one end of the debarking mechanism 1 to the other.

The debarking shafts 3, 3' are arranged with each other in such a way that the processed logs 2 perform a rotary motion C 12 in the debarking mechanism, in which motion the logs 2 are forced on the support surface formed by the debarking shafts 3, 3' by the effect of the rotary motion 5 of the debarking shafts 3, 3' in their turn into the upper position, from which they roll down into the lower position on top of the other logs 2 being processed in the debarking mechanism 1.

In the prior art FIGS. 1 and 2, a fingerplate 11 is arranged above the uppermost debarking shaft 3', the purpose of the fingerplate being to prevent the logs from being wedged between the uppermost debarking shaft 3' and the side wall of the debarking mechanism 1. The bark can usually be discharged from between the debarking shaft 3' and the fingerplate 11 or between two debarking shafts 3 and fall down onto the bark conveyor underneath (not shown).

However, especially bark detached in long strips sometimes causes problems by clogging the gaps between the uppermost debarking shaft 3' and the related fingerplates 11, thus causing the bark to collect into big clots at these uppermost fingerplates 11.

Figure 3:
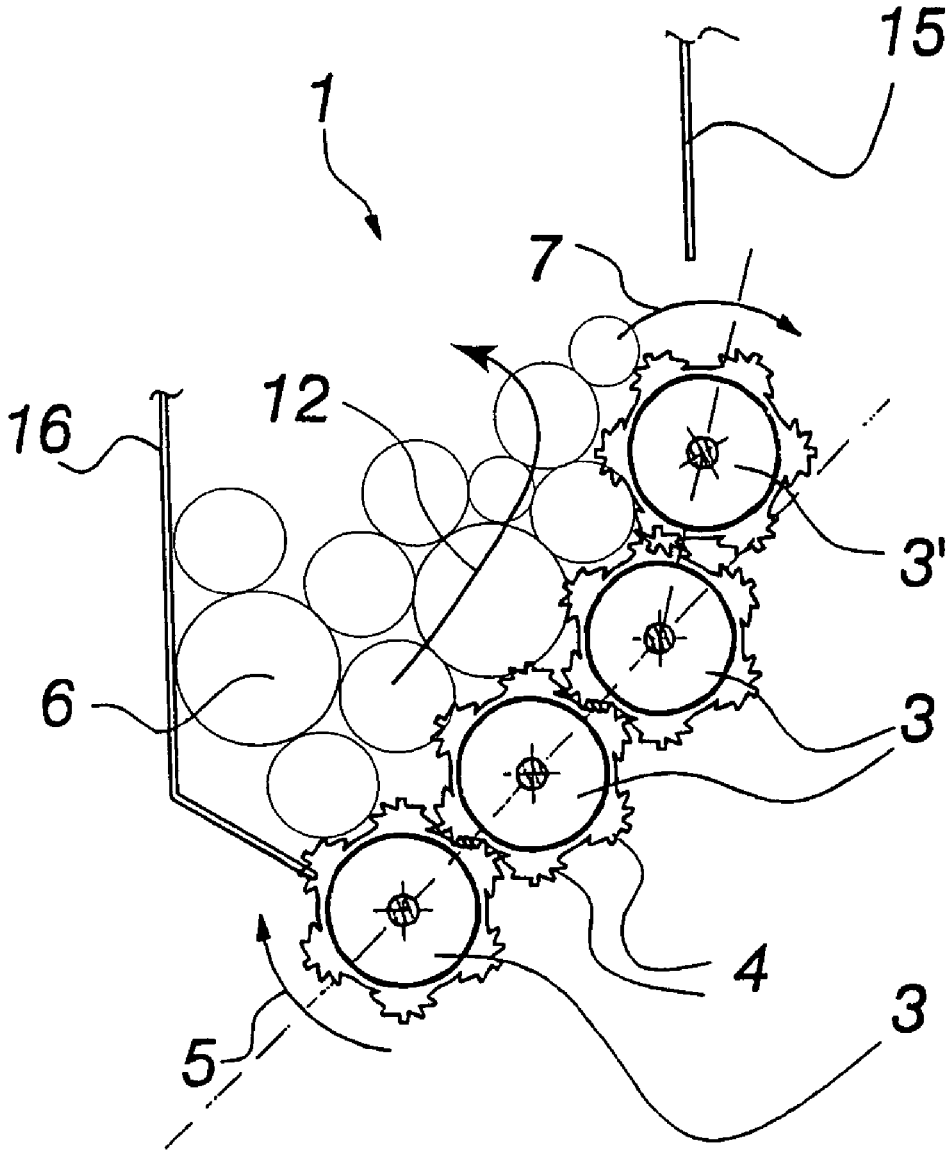
FIG. 3 shows a section of FIG. 2 of the debarking mechanism in accordance with the first embodiment of the invention.

To eliminate the said problem, FIG. 3 shows diagrammatically a solution, in which the uppermost debarking shaft 3', has been moved sideways towards the inner part 6 of the debarking mechanism 1 in such a way that the said debarking shaft directs an impact effect on logs (2) colliding with it and moved by the debarking shafts (3) located in a lower position, due to the effect of which the direction of movement of the logs (2) having collided with the said debarking shaft will change in such a way that, when dividing the movement into a horizontal and a vertical component, the horizontal component of movement will point towards the inner part 6 of the debarking mechanism 1.

In a solution according to the invention, the circumferential speed of the debarking shaft 3, 3' is selected to be the greater the higher the debarking shaft 3, 3' is positioned. On the one hand, this arrangement prevents the logs 2 from being wedged between the debarking shafts 3, 3', and on the other hand facilitates the removal of the bark from the debarking mechanism 1.

When the selected sideways movement of the debarking shaft 3' is extensive enough, the logs 2 are prevented from passing beyond the uppermost debarking shaft 3'. Only the bark can pass beyond the uppermost debarking shaft 3', whereby a free passage 7 has been arranged for this bark, along which it can be removed from the debarking mechanism 1.

In the example of FIG. 3, the said free passage 7 is formed by an opening arranged in the side wall 15 of the debarking mechanism 1, at the debarking shaft 3', through which opening the bark can freely fall down onto the bark conveyor underneath (not shown).

Figure 4:
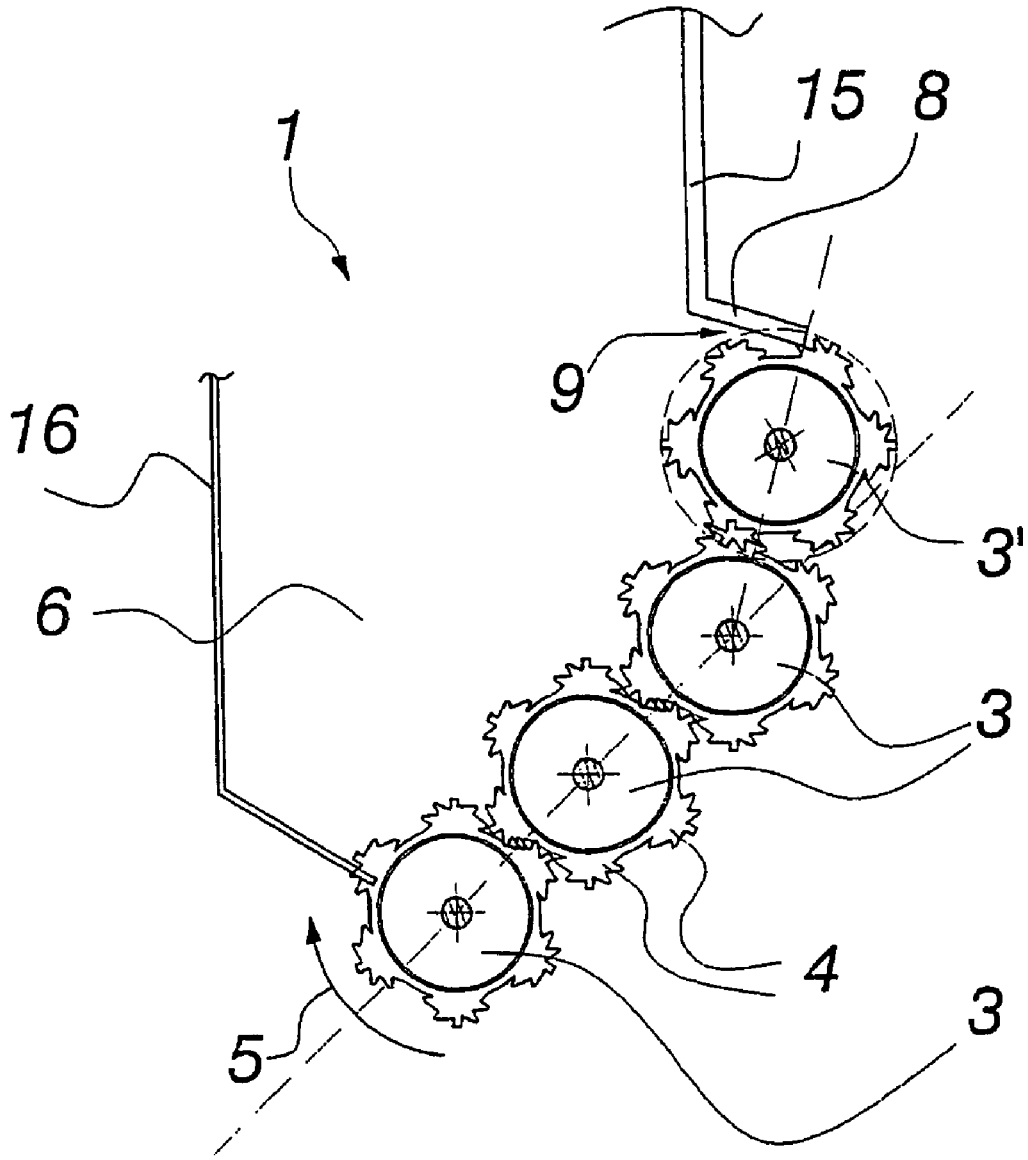
FIG. 4 shows a section according to FIG. 2 of the debarking mechanism in accordance with the second embodiment of the invention.

In the solution according to FIG. 4, a solid guiding surface 8 has been fitted in conjunction with the uppermost debarking shaft 3', the said guiding surface forming, together with the uppermost debarking shaft 3', a slot 9 converging in the direction of rotation 5 of the debarking shaft 3'. In the example of FIG. 4, the guiding surface 8 is a plate-like straight surface, but it may also have a different shape, for example that of an arched surface. The purpose of the guiding surface 8 is primarily to guide the bark as efficiently as possible out of the debarking mechanism 1, but at the same time to prevent logs 2 occasionally passing beyond the uppermost debarking shaft 3' from leaving the debarking mechanism 1 or from being wedged between the uppermost debarking shaft 3' and the side wall 15 of the debarking mechanism 1. The guiding surface 8 is arranged so that the bark conveyed by the uppermost debarking shaft 3' collide with it in a sharp angle while travelling towards the slot 9.

Figure 5:
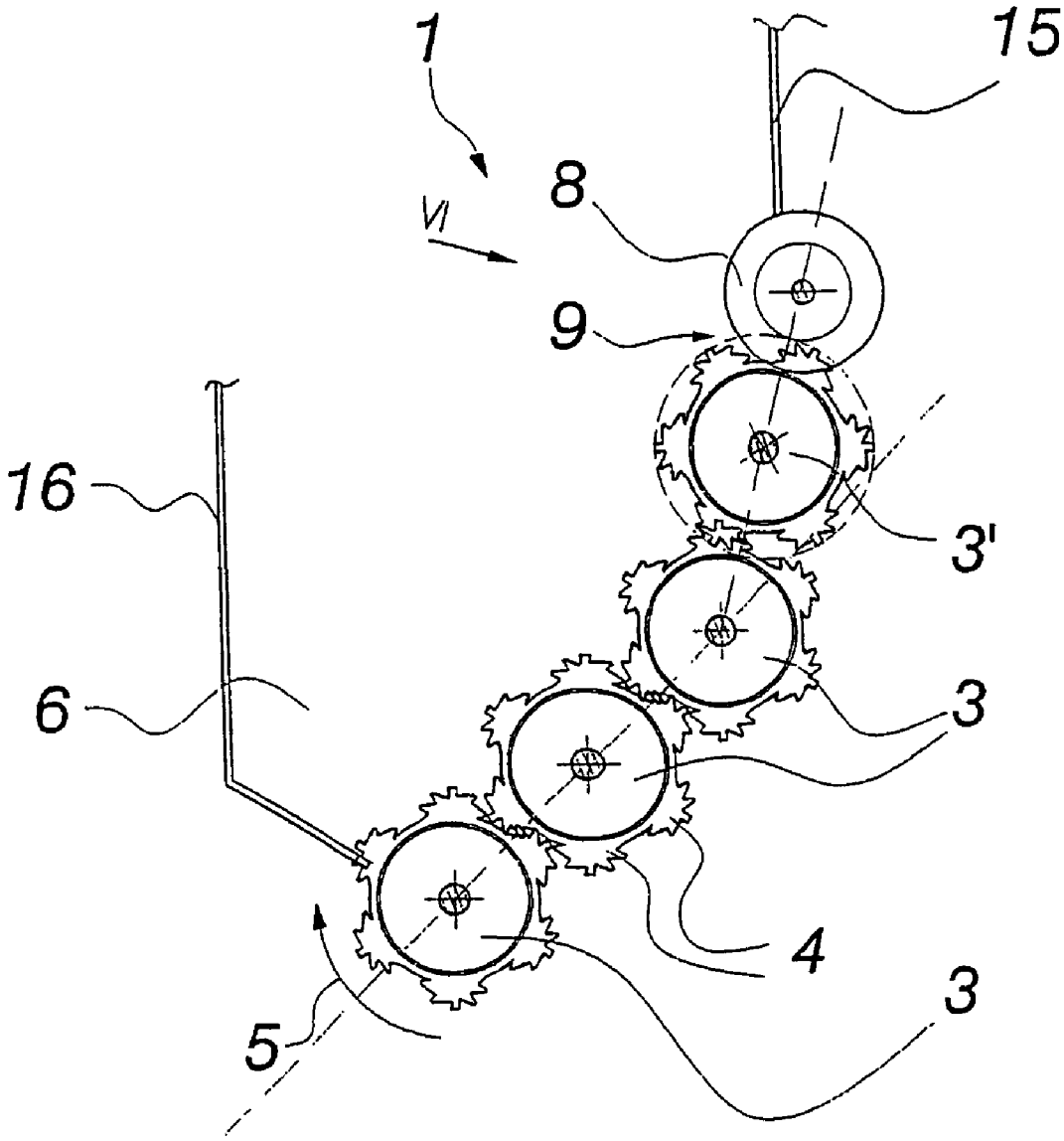
FIG. 5 shows a section according to FIG. 2 of the debarking mechanism in accordance with the third embodiment of the invention.

In the example of FIG. 5, the guiding surface 8 is formed by a toothless, freely rotating or independently rotatable roller resembling the debarking shafts 3, 3' in structure, whereby the teeth 4 of the uppermost debarking shaft force the bark to be discharged through the slot 9 between the uppermost debarking shaft 3' and the roller 8.

Figure 6:
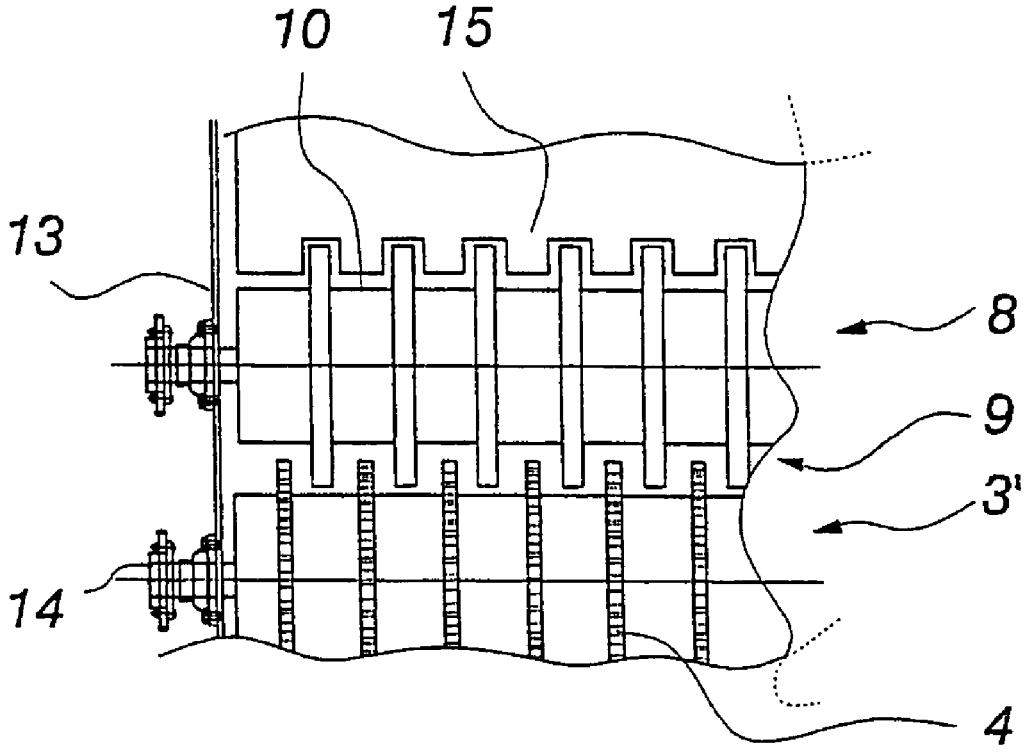
FIG. 6 shows a partial view in the direction of arrow VI in FIG. 5.

The guiding surface 8 is—regardless of whether it is a rotating or fixed guiding surface, or whether the guiding surface has a plate-like, cylindrical or some other form—preferably provided with grooves 10 for interlocking the said guiding surface and the teeth 4 of the uppermost debarking shaft 3' and for thus forming a slot 9 of the desired size (FIG. 6). Due to this arrangement, bark that has been pushed through the slot 9 at some point as forced by the tooth 4, can no longer easily return through the slot 9, whereby the adjacent teeth 4 will force also the rest of the bark strip to pass through the slot 9. The movable guiding surface 8 formed by the rotatable or freely rotating roller further facilitates the entry of the bark into the slot 9 and out of the debarking mechanism 1 therethrough.

The invention claimed is:

1. A method for removing bark from logs in a log debarker having an open ended chute formed between opposing support surfaces, wherein one of the support surfaces includes a plurality of debarking shafts arranged side-by-side and in a debarking plane and the one of the support surfaces further includes an offset debarking shaft parallel to and adjacent one of the debarking shafts in the debarking plane, the method comprising:

advancing the logs through the chute of the log debarker in a direction generally parallel to debarking shafts and the debarking plane;

rotating the debarking shafts which include debarking teeth that cut bark from logs abutting the rotating shafts;

rotating at least the offset debarking shaft at a faster rotational speed than the rotational speed of one or more of the debarking shafts in the debarking plane;

by rotating the debarking shafts, deflecting logs and bark removed from the logs upwards while in the chute, and discharging the removed bark from the chute and over the rotating offset debarking shaft.

2. A method as in claim 1 wherein the one of the support surface includes a guiding surface arranged parallel to and adjacent the offset debarking shaft, and the step of moving bark upward includes moving the bark through a slot between the guiding surface and the offset debarking shaft, wherein the slot converges in a direction aligned with a rotational direction of the offset debarking shaft.

3. A method as in claim 1 wherein the debarking plane is slanted upwards such that the debarking shafts are arranged at different elevations, and the method includes rotating the debarking shafts higher in the plane faster than rotating lower debarking shafts, wherein the offset debarking shaft rotates faster than the debarking shafts in the debarking plane.

4. A method as in claim 3 wherein each successively higher debarking shaft rotates faster than an immediately lower debarking shaft in the debarking plane.

5. A method as in claim 1 wherein the offset debarking shaft rotates faster than all of the debarking shafts in the debarking plane.

6. A method as in claim 1 wherein the advancement of the logs through the debarker is generally horizontal.

7. A method as in claim 1 further comprising a generally oval circulation of the logs in the debarker caused by the rotation of the debarking shafts, wherein the oval circulation is transverse to the debarking shafts.

8. A method as in claim 7 wherein the oval circulation of logs in the debarker is transverse to the debarking shafts.

9. A log debarker comprising:

an open-ended chute having a first sidewall, a bottom surface and a second sidewall opposite to the first sidewall, the first sidewall including a plurality of rotating debarking shafts arranged side-by-side and in a debarking plane, said shafts being parallel to an advancing direction of the logs through the chute and include debarking features projecting from an outer shaft surface;

the debarking shafts rotating in a direction to deflect the logs and removed bark upward in a direction substantially transverse to the advancing direction and, an offset debarking shaft parallel to and adjacent one of the debarking shafts in the debarking plane, the offset debarking shaft including debarking features and the offset debarking shaft being offset in a direction upward from the debarking plane, wherein a rotational speed of the offset debarking shaft is faster than a rotational speed of the debarking shafts in the debarking plane.

10. A log debarker as in claim 7 further comprising a guiding surface parallel to and upwards of the offset debarking shaft, and a slot between the guiding surface and the offset debarking shaft to pass bark removed from logs in the debarker.

11. A log debarker as in claim 7 wherein the debarking plane is slanted upwards such that the debarking shafts are arranged at different elevations, and a rotational speed of the debarking shafts is faster for debarking shafts higher in the debarking plane than for lower debarking shafts.

12. A log debarker as in claim 9 wherein each successively higher debarking shaft rotates faster than the debarking shafts lower in the debarking plane.

13. A log debarker as in claim 9 wherein the offset debarking shaft rotates faster than all of the debarking shafts in the debarking plane.

14. A log debarker as in claim 9 further comprising a guiding surface above the offset debarking shaft, and the guiding surface and the offset debarker shaft defining therebetween a slot converging in a rotational direction of the offset debarking shaft.

15. A log debarker as in claim 14 wherein the guiding surface, includes grooves extending circumferentially outward of the surface and the grooves interlace with teeth projecting from a cylindrical surface of the offset debarking shaft.

* * * * *